US006558631B1

(12) United States Patent
Day

(10) Patent No.: US 6,558,631 B1
(45) Date of Patent: May 6, 2003

(54) MULTI-WELL PLATES

(75) Inventor: Paul Francis Day, Chipstead (GB)

(73) Assignee: Advanced Biotechnologies Ltd., Epsom (GB)

( * ) Notice: Subject to any disclaimer, the term of this patent is extended or adjusted under 35 U.S.C. 154(b) by 0 days.

(21) Appl. No.: 09/575,068

(22) Filed: May 19, 2000

(30) Foreign Application Priority Data

May 20, 1999 (GB) ..... 9911609

(51) Int. Cl.[7] ..... B01L 3/00

(52) U.S. Cl. ..... 422/102; 422/99; 428/43; 206/538; 435/288.4; 435/287.2

(58) Field of Search ..... 422/99–103; 428/43; 206/538; 435/287.2, 288.4

(56) References Cited

U.S. PATENT DOCUMENTS

| | | | | | |
|---|---|---|---|---|---|
| 3,630,346 | A | * | 12/1971 | Burnside | 206/445 |
| 3,677,397 | A | * | 7/1972 | Beckham | 206/539 |
| 3,722,502 | A | * | 3/1973 | Besuner et al. | 600/575 |
| 3,780,892 | A | * | 12/1973 | Frank | 414/416.09 |
| 3,782,066 | A | * | 1/1974 | Schmitt | 53/412 |
| 3,907,505 | A | | 9/1975 | Beall et al. | 23/259 |
| 3,938,281 | A | * | 2/1976 | Ingerstedt et al. | 47/84 |
| 4,154,795 | A | * | 5/1979 | Thorne | 422/99 |
| 4,246,339 | A | * | 1/1981 | Cole et al. | 435/7 |
| 4,518,081 | A | * | 5/1985 | Larosiere | 206/158 |
| 4,588,341 | A | * | 5/1986 | Motoda | 414/331.14 |
| 4,599,315 | A | * | 7/1986 | Terasaki et al. | 435/301 |
| 4,875,620 | A | | 10/1989 | Lane, Sr. | 229/1.5 B |
| 4,877,659 | A | * | 10/1989 | Vince | 428/34.1 |
| 4,968,625 | A | | 11/1990 | Smith et al. | 435/301 |
| 5,084,246 | A | | 1/1992 | Lyman et al. | 422/101 |
| 5,096,672 | A | | 3/1992 | Tervamäki et al. | 422/102 |
| 5,409,127 | A | | 4/1995 | Stratford et al. | 220/23.4 |
| 5,514,343 | A | * | 5/1996 | Verwohlt et al. | 422/104 |
| 6,132,685 | A | * | 10/2000 | Kercso et al. | 422/104 |

FOREIGN PATENT DOCUMENTS

| | | | | |
|---|---|---|---|---|
| EP | 597 288 | | 5/1994 | B01L/3/00 |
| EP | 638 364 | | 2/1995 | B01L/3/00 |
| GB | 2 288 233 | | 10/1995 | B01L/3/00 |
| GB | 2 328 669 | | 3/1999 | B65D/1/36 |
| JP | 07051049 | A * | 2/1995 | |

* cited by examiner

*Primary Examiner*—Jill Warden
*Assistant Examiner*—Yelena Gakh
(74) *Attorney, Agent, or Firm*—Synnestvedt & Lechner LLP

(57) ABSTRACT

A multi-well plate comprising a plurality of discrete tubes held together in an array by a plate portion, characterised in that one or more section lines are provided in the plate portion in pre-determined regions, said section lines being adapted to facilitate dividing up the multi-well plate into sub-units of a pre-determined size.

10 Claims, 2 Drawing Sheets

MULTI-WELL PLATES

FIELD OF THE INVENTION

The present invention relates generally to containers for holding liquids, reagents, and materials, for testing, analytical procedures, and performance of chemical reactions. It is particularly applicable, but in no way limited, to multi-well plates.

BACKGROUND OF THE INVENTION

Multi-well plates, or two-dimensionally bound arrays of wells or reaction chambers, are commonly employed in research and clinical procedures for the screening and evaluation of multiple samples. Multi-well plates are especially useful in conjunction with automated thermal cyclers for performing the widely used polymerase chain reaction, or "PCR", and for DNA cycle sequencing and the like. They are also highly useful for biological micro-culturing and assay procedures, and for performing chemical syntheses on a micro scale.

Multi-well plates may have wells or tubes that have single openings at their top ends, similar to conventional test tubes and centrifuge tubes, or they may incorporate second openings at their bottom ends which are fitted with frits or filter media to provide a filtration capability. As implied above, multi-well plates are most often used for relatively small scale laboratory procedures and are therefore also commonly known as "microplates".

Multi-well plates for PCR use are typically comprised of a plurality of plastic tubes arranged in rectangular planar arrays of typically 3×8 (a 24 well plate), 6×8 (a 48 well plate) or 8×12 (a 96 well plate) tubes with an industry standard 9 mm (0.35 in.) centre-to centre tube spacing (or fractions thereof). As technology has advanced plates with a larger number of wells have been developed such as 16×24 (a 384 well plate). A horizontally disposed tray or plate portion generally extends integrally between each tube, interconnecting each tube with its neighbour in a cross-web fashion. In the case of multi-well plates that are of the non-filtration variety, the bottoms of the tubes may be of a rounded conical shape (as generally used for thermal cycling and to ensure complete transfer of samples), or they may be flat-bottomed (typical with either round or square-shaped designs used with optical readers). Multi-well "plates" may also exist in a "strip" form wherein a single planar row of interconnected tubes is provided.

It will be apparent that as many as 96 individual reaction mixtures can be simultaneously subjected to, for example, PCR treatment by placing a single multi-well plate within a thermal cycler unit. Most commercial thermal cyclers that are presently available have heating/cooling blocks with conically shaped depressions, typically 96 in number, which are specifically designed and arrayed for mateably receiving the lower portion of the tubes of multi-well plates so that intimate and uniform heating of the PCR reaction mixtures contained within the wells (tubes) may occur.

With the variety of operations and reaction conditions available to the scientist there is an increasing requirement to operate on a variable number of samples. In addition, it is often necessary to carry out subsequent operation(s) on just a portion of samples which have undergone a first processing. In order to achieve this the samples must be subdivided into subsets for further investigation/reaction. This can currently be achieved by using a number of small plate arrays to total 96 and by selecting just some of the plate arrays for subsequent processing. For example, one could choose two 3×8 plates and one 6×8 plate to give a fill 96 well cycler. Alternatively, a conventional 96 well plate can be used and this can be physically cut up into smaller arrays at a suitable point or points in the process. However, both these methods have inherent disadvantages.

Firstly, pre-selecting plate blocks requires considerable pre-planning and also presupposes the results of the first set of reactions. Once chosen, there is no subsequent flexibility as to the number in each block. In addition, this method greatly increases the number of manual handling operations since each block must be picked up separately. Furthermore, these smaller blocks are generally not amenable to robotic handling, whilst conventional 96 and 384 multi-well plates are routinely handled robotically.

Cutting up conventional plates has the advantage that the size of the subsets can be determined by the operator at any time, providing increased flexibility. However, once the plates have been cut manually they can only be placed in a thermal cycler in their original orientation. Inevitable irregularities in the cuts means the subsets will only fit together to reform the original plate. Manual cuts are never entirely straight and the misalignment of adjacent blocks prevents them sifting properly in the cycler in anything other than their original configuration. This is usually overcome by leaving a gap of one row of wells between adjacent blocks. This in itself is unsatisfactory because it means that extra runs of the cycler may need to be carried out to make up for the empty rows.

It is the object of the present invention to provide multi-well plates which overcome or mitigate some or all of these problems.

SUMMARY OF THE INVENTION

According to the present invention there is provided a multi-well plate comprising a plurality of discrete tubes held together in an array by a plate portion, characterised in that one or more section lines are provided in the plate portion in pre-determined regions, said section lines being adapted to facilitate dividing up the multi-well plate into sub-units of a pre-determined size.

Forming section lines in the plate either during the moulding process or subsequently, enables the operator to divide the plate into smaller sub-units which will still fit together side by side in a thermal cycler or the like.

Preferably the section lines are formed by a score line extending across the width of the plate. A score line is defined as any feature which facilitates the separation of the plate into sub-units.

Preferably the section line or score line comprises one or more apertures extending through the thickness of the plate portion. By forming a series of apertures, preferably elongate in shape, the plate can easily be separated into sub-units.

In a particularly preferred embodiment the section line incorporates one or more lugs connecting adjacent sub-units. Preferably the lugs are of a snap-off construction, such that the lugs associated with a section line can be removed in the event that plate is divided into sub-units along that section line.

These lugs provide the plate with rigidity when it is in its original configuration before subdivision. However, the lugs are easily removed when the plate is sub-divided. For example, the lugs may be substantially circular regions which extend across the section line. They may be partially punched out or weakened around their circumference for ease of removal.

Alternatively the section line may comprise a pull-out strip or a series of perforations.

Preferably the plate incorporates a skirt around the perimeter of the plate in order to increase the rigidity of the plate. The skirt also provides space upon which to label the plate and its individual sub-units.

In a particularly preferred embodiment the skirt incorporates gaps at strategic points to facilitate robotic handling.

In a further preferred embodiment the rim of each tube in the multi-well plate extends proud of the plate portion.

BRIEF DESCRIPTION OF THE DRAWINGS

The present invention will now be described by way of example only with reference to the accompanying drawings wherein.

DESCRIPTION OF THE PREFERRED EMBODIMENTS

The present examples illustrate the best ways known to the applicant of putting the invention into practice. But they are not the only ways in which this can be achieved.

Figure 1A:
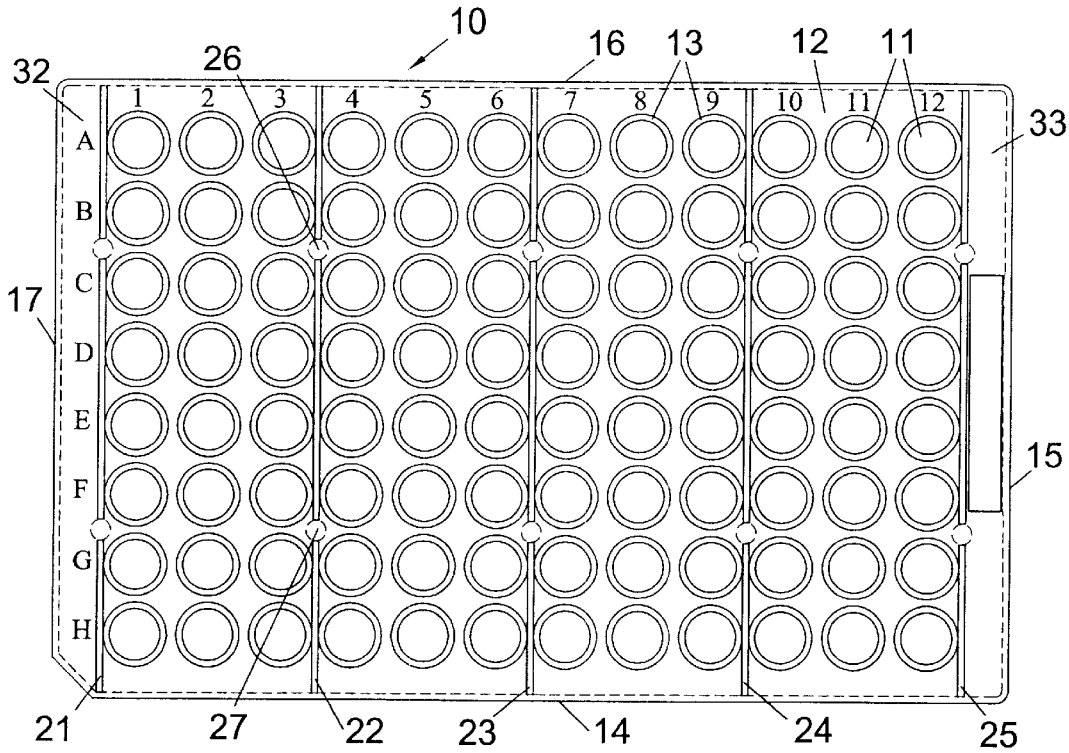
FIG. 1 illustrates plan and side elevations of a pre-sectioned 96 well plate.

Referring to FIG. 1A this illustrates a plan view of a 96 well plate according to a first embodiment of the invention. FIG. 1A shows a 96 well plate 10 consisting of 96 wells 11 held in a fixed configuration by a plate portion 12. In this example the plate portion is a substantially flat, substantially continuous rectangular sheet of plastics material abutting and surrounding each well.

The wells are positioned in the plate portion such that only a rim 13 of each well projects above the top of the plate portion with the multi-well plate in its normal orientation in use. The rims 13 are designed to form a better contact with any seal placed over the plate. Such sealing methods include micromats, adhesive sealing sheets or foils. However, these rims are not an essential feature of the present invention. They simply improve the performance of the plates when they have to be sealed.

In this example a skirt is formed around the plate 10 by depending edges 14–17 inclusive of the plate portion. This skirt serves a number of functions. It increases the rigidity of the multi-well plate. It also provides apertures 18, 19 for the fingers of a robot to permit robotic handling of the plates. Similar apertures (not shown) are provided in the other edges of the plate. In addition the skirt provides a useful surface on which to label the plate to record its contents and any reaction sequences.

Figure 2A:
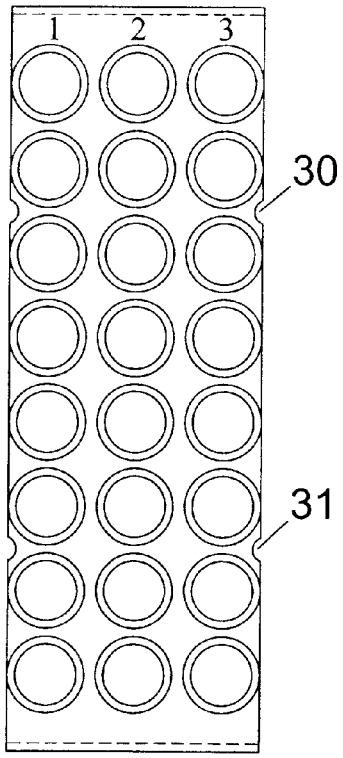
FIGS. 2 and 3 illustrate 24 and 48 will sections separated from the 96 well plate shown in FIG. 1.
Figure 3A:
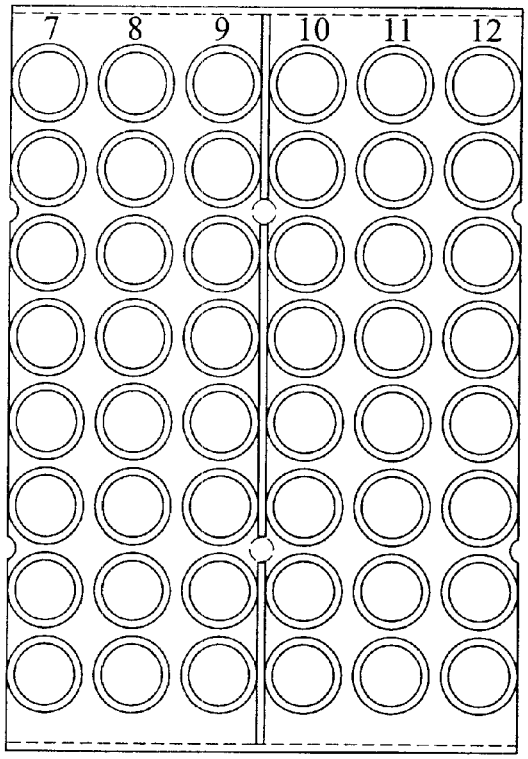
Figure 2B:
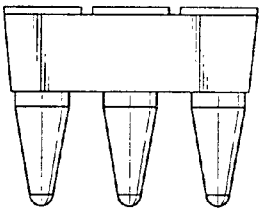
Figure 3B:
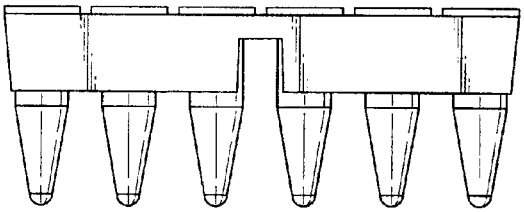

Thus far, the description has been of a relatively conventional multi-well plate. However, it has been discovered that by providing slits 21–25 inclusive the adaptability of the plates can be greatly improved. These slits or apertures act as section lines, located in pre-determined regions of the plate portion and facilitate dividing up the plate into smaller sub-units or blocks. Two such sub-units are illustrated in FIGS. 2 and 3.

Whilst the slits extend substantially entirely across the width of the plate there obviously must be certain regions where connection is made between adjacent sub-units. In this example there are two small connections 26, 27 in the top of the plate and, in addition, the skirt at both ends of the slit is intact.

It will therefore readily be appreciated that the plate can be snapped by bending it about the widthwise slots.

Alternatively it can be cut up using scissors, a knife or a scalpel, or other sharp implement to form sub-units as required. Any stray material around the connections can be trimmed off easily with a knife.

In order that the sub-units may be placed in any order within a thermal cycler the end portions 32 and 33 are also detachable in the same way.

Figure 1B:
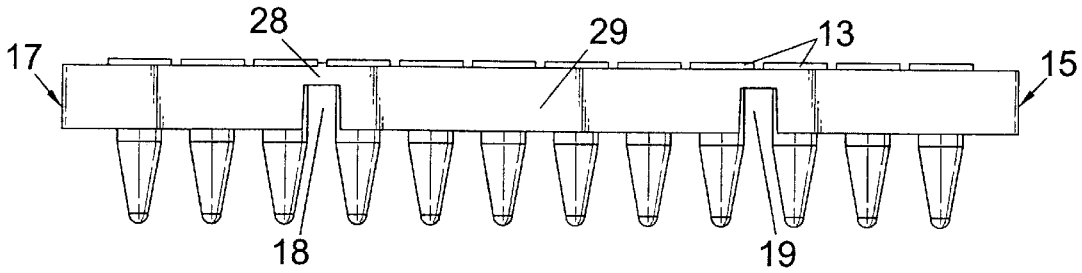

In a further embodiment the connections between adjacent sub-units can be formed by substantially circular regions as shown in FIG. 1, which are partially punched out or weakened around their circumference. The connecting regions, which extend across the apertures, can then be removed in their entirety simply by snapping them off. This results in the semicircular indentations 30 and 31 shown in FIG. 2A.

The technology to produce such weakened, snap-out or snap-off regions is well known in the packaging field.

In the embodiment illustrated the slits 21 to 25 have a finite width. In this example the gap between adjacent sub-units is approximately 0.5 mm. The space between adjacent wells in a 96 well plate is fixed and the slit cannot therefore exceed this dimension. Typically the width of the slit can range from 0.1 mm to 1 mm in a 96 well plate. In other formats wider or narrower slits may be possible.

By forming the division between sub-units as a slit with a finite width, this ensures that, once separated, the various sub-units will fit side by side in a thermal cycler in any combination or orientation without touching or interfering with each other.

However, a slit or slot is not the only way that this can be achieved. In fact, the term section line has a broad meaning in this context and is intended to encompass any construction that can achieve the results described above. For example, perforations or a pull-out strip could be used to separate the sub-units as well as a variety of forms of elongate aperture. The technology to form perforations, or a series of perforations in a sheet of plastic is well-known to those skilled in the art. When perforations are used it may be necessary to trim off with a knife any excess plastics material between adjacent sub-units.

The term "multi-well plate" in this context also has a broad meaning. This term encompasses an assembly of containers, of whatever size and shape, intended to contain or hold fluid, even on a temporary basis. It is specifically intended to cover plates which have application beyond the PCR application described above.

In addition, the term "plate portion" is not limited to a flat sheet-like structure at or near the well rims. It is intended to encompass any connecting structure which holds wells, chambers or other receptacles in place.

What is claimed is:

1. A multi-well plate of the type used for PCR reactions, said plate comprising a plurality of discrete tubes held together in an array by a plate portion, the plate portion being sub-divided into adjacent sub-units of a pre-determined size by one or more slits extending substantially across the width of the plate portion, the slits extending through the entire thickness of the plate portion, the adjacent sub-units being connected by one or more connecting regions associated with each of said slits, said connection regions being formed by substantially circular regions which extend across the slits, said circular regions being weakened around their circumferences to facilitate removal from said plate portion, the arrangement of slits and connecting regions being adapted to facilitate dividing up the multi-well plate into said sub-units of pre-determined size which will then fit into a thermal cycler without interfering with each other.

2. A multi-well plate as claimed in claim 1 wherein the plate incorporates a skirt around the perimeter of the plate in order to increase the rigidity of the plate.

3. A multi-well plate as claimed in claim 2 wherein the skirt incorporates apertures at strategic points to facilitate robotic handling.

4. A multi-well plate according to claim 1, wherein the connecting regions are partially punched out around their circumferences to facilitate removal from said plate portion.

5. A multi-well plate according to claim 1, wherein said slits have a width within the range from 0.1 mm to 1 mm.

6. A multi-well plate according to claim 1, wherein said slits have a width of approximately 0.5 mm.

7. A multi-well plate according to claim 1, further comprising end portions removably attached to said plate portion, said end portions being defined by one of said slits positioned between said plate portion and said end portion and being attached to said plate portion by said connecting regions.

8. A multi-well plate of the type used for PCR reactions, said plate comprising a plurality of discrete tubes held together in an array by a plate portion, said plate portion being sub-divided into a plurality of adjacent sub-units by one or more slits extending substantially cross said plate portion, the adjacent sub-units being connected by a plurality of connecting regions, said connecting regions being formed by substantially circular regions which extend across the slits, said circular regions being weakened around their circumferences to facilitate removal from said plate portion, the plate portion further comprising detachable end portions, the end portions being devoid of tubes and being defined by said slits and connected to said adjacent sub-units by a plurality of said connecting regions.

9. A multi-well plate according to claim 8, wherein said slits have a width within the range from 0.1 mm to 1 mm.

10. A multi-well plate according to claim 8, wherein said slits have a width of approximately 0.5 mm.

* * * * *